US009144321B2

(12) United States Patent
Melo

(10) Patent No.: US 9,144,321 B2
(45) Date of Patent: Sep. 29, 2015

(54) HIGHCHAIR TRAY COVER SYSTEM WITH MAGNETICALLY ATTACHABLE OBJECTS

(71) Applicant: Kelly Ann Melo, Santa Clarita, CA (US)

(72) Inventor: Kelly Ann Melo, Santa Clarita, CA (US)

( * ) Notice: Subject to any disclaimer, the term of this patent is extended or adjusted under 35 U.S.C. 154(b) by 0 days.

(21) Appl. No.: 14/230,805

(22) Filed: Mar. 31, 2014

(65) Prior Publication Data

US 2014/0299608 A1 Oct. 9, 2014

Related U.S. Application Data

(60) Provisional application No. 61/810,188, filed on Apr. 9, 2013.

(51) Int. Cl.

| | |
|---|---|
| ***A47B 39/00*** | (2006.01) |
| ***A47D 1/00*** | (2006.01) |
| ***A47G 11/00*** | (2006.01) |
| ***A47G 19/10*** | (2006.01) |
| ***A47G 23/03*** | (2006.01) |

(52) U.S. Cl.

CPC ..... *A47D 1/008* (2013.01); *A47G 11/004* (2013.01); *A47G 19/10* (2013.01); *A47G 23/0303* (2013.01); *Y10T 428/24008* (2015.01); *Y10T 428/24017* (2015.01)

(58) Field of Classification Search

CPC ..... A47D 15/00; A47D 1/008; A47G 19/10
USPC ..... 297/135, 148, 153, 219.12, 228.12
See application file for complete search history.

(56) References Cited

U.S. PATENT DOCUMENTS

| | | | | | |
|---|---|---|---|---|---|
| 2,726,838 | A | * | 12/1955 | Ripley, Jr. | 248/499 |
| 3,123,935 | A | | 3/1964 | Williams | |
| 3,483,494 | A | | 12/1969 | Cromie | |
| 3,508,183 | A | | 4/1970 | Pinckard | |
| 3,610,459 | A | * | 10/1971 | Hanson | 220/23.83 |
| 3,729,037 | A | * | 4/1973 | Dare et al. | 150/158 |
| 4,416,438 | A | | 11/1983 | King | |
| 4,826,059 | A | | 5/1989 | Bosch et al. | |
| 4,944,311 | A | | 7/1990 | Eldridge, Jr. et al. | |
| D356,531 | S | * | 3/1995 | Valenti | D12/133 |
| 5,586,800 | A | * | 12/1996 | Triplett | 297/148 |
| 5,641,140 | A | * | 6/1997 | Sorenson | 248/205.3 |
| 5,720,226 | A | * | 2/1998 | Padovano | 108/25 |
| 5,975,628 | A | * | 11/1999 | Russell | 297/135 |
| 6,109,188 | A | * | 8/2000 | Russell | 108/44 |
| 6,179,377 | B1 | * | 1/2001 | Harper | 297/148 |
| 6,216,605 | B1 | * | 4/2001 | Chapman | 108/26 |
| 6,224,450 | B1 | * | 5/2001 | Norton | 446/28 |
| 6,457,423 | B1 | * | 10/2002 | Gordon | 108/90 |
| 6,497,452 | B2 | * | 12/2002 | Catelli | 297/153 |
| 6,511,124 | B2 | * | 1/2003 | Combs | 297/135 |
| 6,631,950 | B1 | * | 10/2003 | Madole | 297/228.11 |

(Continued)

FOREIGN PATENT DOCUMENTS

GB 2424357 A 9/2006

*Primary Examiner* — Laurie Cranmer
(74) *Attorney, Agent, or Firm* — Kelly & Kelley, LLP

(57) ABSTRACT

A highchair system enables removable attachment of objects to a tray of the highchair and protects the highchair from food and liquid spills. A flexible slipcover is removably attachable to the highchair tray so as to extend over at least an upper surface thereof. A permanent magnet or a ferromagnetic material is associated with the slipcover. Objects, such as a dish or a toy, are held in place on the highchair tray by magnetic attraction forces. Tethered utensils may be removably attachable to the dish.

16 Claims, 6 Drawing Sheets

(56) References Cited

U.S. PATENT DOCUMENTS

| | | | | |
|---|---|---|---|---|
| 6,920,830 | B1 * | 7/2005 | Asbach et al. | 108/26 |
| 7,328,941 | B2 * | 2/2008 | Asbach et al. | 297/153 |
| 7,475,937 | B2 * | 1/2009 | McGrew et al. | 297/148 |
| 7,841,658 | B1 * | 11/2010 | Marble | 297/224 |
| 7,992,714 | B1 * | 8/2011 | Devault et al. | 206/564 |
| 8,002,140 | B2 * | 8/2011 | Schantz et al. | 220/574.1 |
| 8,166,893 | B2 * | 5/2012 | Davis | 108/90 |
| 8,388,403 | B2 * | 3/2013 | Seter | 446/227 |
| 8,468,958 | B2 * | 6/2013 | Giabanis | 108/98 |
| 2001/0035112 | A1 * | 11/2001 | Guard et al. | 108/25 |
| 2002/0096914 | A1 * | 7/2002 | Combs | 297/135 |
| 2002/0178975 | A1 * | 12/2002 | Lewis et al. | 108/90 |
| 2004/0026429 | A1 | 2/2004 | Baldewsingh et al. | |
| 2007/0029848 | A1 * | 2/2007 | Probst | 297/148 |
| 2007/0029849 | A1 * | 2/2007 | Eckstein et al. | 297/153 |
| 2007/0039966 | A1 * | 2/2007 | Schantz et al. | 220/574 |
| 2007/0051285 | A1 * | 3/2007 | French et al. | 108/90 |
| 2009/0229130 | A1 | 9/2009 | Swierski et al. | |
| 2010/0154683 | A1 * | 6/2010 | Royka | 108/28 |
| 2011/0056413 | A1 * | 3/2011 | Andochick | 108/14 |
| 2011/0232102 | A1 | 9/2011 | Holmes | |
| 2011/0315593 | A1 * | 12/2011 | Angus et al. | 206/541 |
| 2012/0056441 | A1 | 3/2012 | Chavarria et al. | |
| 2012/0117776 | A1 | 5/2012 | Bourns et al. | |
| 2012/0267922 | A1 * | 10/2012 | Fleming | 297/135 |
| 2013/0105492 | A1 * | 5/2013 | Melgoza | 220/574 |
| 2013/0285421 | A1 * | 10/2013 | Huntsberger et al. | 297/174 R |

* cited by examiner

HIGHCHAIR TRAY COVER SYSTEM WITH MAGNETICALLY ATTACHABLE OBJECTS

RELATED APPLICATION

This application claims priority to U.S. Provisional Patent Application Ser. No. 61/810,188, filed on Apr. 9, 2013.

BACKGROUND OF THE INVENTION

The present invention generally relates to the field of highchairs for feeding infants. More particularly, the present invention relates to a removable cover for a highchair tray to which dishes and other objects can be magnetically attached.

It is well known that at mealtimes, infants and small children are placed in highchairs to be fed. The child may be strapped into a seat portion, and then a tray is attached to the highchair in front of the child. The use of the highchair allows the parents to securely place the child in the highchair and provide an eating tray for the child to consume their food. Use of the highchair also helps to limit the movement and mobility of the child during a meal.

Many times, children are provided with relatively small dishware, such as small bowls, plates, and cups, as well as utensils that are suitable for the child's hands during the feeding. However, children while consuming their meals in a highchair oftentimes spill, drop, or occasionally throw or toss the dishware and/or utensils from the tray of the highchair. Such incidents are common and provide an extra chore for the parent or caregiver in cleaning up the mess which results from the spillage that usually occurs due to the spilling or throwing of the dishware or utensils.

One attempt to control this has been to use dishes and cups that have vacuum or suction cups on their bases, so that the suction cups will hold the dishes on the highchair tray. Unfortunately, the vacuum does not hold for long on these, and after a short while the dishes come loose and the child can knock them off the tray. Also, the soft rubber material of the suction cup can wear out, especially if the dishes are washed at high temperatures in an automatic dishwasher.

U.S. Pat. No. 6,216,605 discloses a highchair having a tray with a contoured recess and slots which receives corresponding tang elements extending from a base of a dish so as to removably lock the dish to the tray. However, this has several drawbacks, including the creation of a highly specialized tray and dish. Moreover, food and beverage can enter into the recesses and slots, making it more difficult to clean the tray.

U.S. Patent Publication No. 2012/0267922 discloses a highchair tray system utilizing a plurality of cords or other means of securing the dishware directly onto the tray. This is also a complicated system and provides various drawbacks, including the need for a modified or specially-created tray. This system also does not prevent a dish from being turned over or removed from the tray.

U.S. Pat. No. 6,179,377 discloses a highchair having a tray that has a steel/ferromagnetic core or insert layer to be used with children's dishware that have permanent magnets in their bases or bottoms. Once again, this requires that magnets be attached to or formed in the bases of specialized dishes, and that a specialized tray be created.

Accordingly, there is a continued need for a highchair tray cover system having a flexible cover which can be attached to a variety of existing highchair trays. Such a cover should stay in place on the tray, but yet be easily removed and washed. Such a system should also include objects capable of being magnetically attached to the tray so as to prevent the infant from removing the object from the tray. Such objects should include dishes, having utensils tethered thereto. The present invention fulfills these needs, and provides other related advantages.

SUMMARY OF THE INVENTION

The present invention resides in a highchair system that enables removable attachment of objects to a tray of a highchair, while protecting the highchair tray from food and liquid spills. The system generally comprises a flexible slipcover which is removably attachable to the highchair tray so as to cover at least an upper surface of the highchair tray. The slipcover may extend over the upper surface as well as at least a portion of the side wall surfaces of the highchair tray. The slipcover may be comprised of a material, or has an upper surface, that is fluid resistant or fluid impermeable.

The slipcover includes an adaptive connector that facilitates connection of the slipcover to the highchair tray. For example, the adaptive connector may comprise an elastic disposed adjacent to at least a portion of a peripheral edge of the slipcover. The adaptive connector may comprise a cord associated with the slipcover, which is selectively drawn to tighten the slipcover on the highchair tray. A lock may be associated with the cord for selectively locking the cord. The adaptive connector may also comprise hook and loop tape fasteners.

A material having magnetic attraction properties is associated with the slipcover. Such a material may comprise a permanent magnet. The magnet may be attached to a lower surface of the highchair tray. Alternatively, the magnet may be disposed within a pouch formed in the slipcover.

Objects comprising ferromagnetic material or a magnet may be placed over the material having magnetic attraction properties associated with the slipcover and held in place on the highchair tray by magnetic attraction forces. The object may include a dish comprised of a ferromagnetic material or including a magnet which is removably attached to the slipcover by magnetic attraction to the material having magnetic attraction properties. In the case when the material is a permanent magnet, the dish is comprised of a ferromagnetic material that is removably connected to the slipcover by magnetic attraction to the permanent magnet associated with the slipcover. In one embodiment, a tether interconnects a utensil to the dish.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention is directed to a highchair system, generally referred to by the reference number 10, which enables removable attachment of objects to a tray 12 of a highchair 14, and which protects the highchair tray 12, the highchair 14 and the surrounding area from food and liquid spills.

Figure 1:
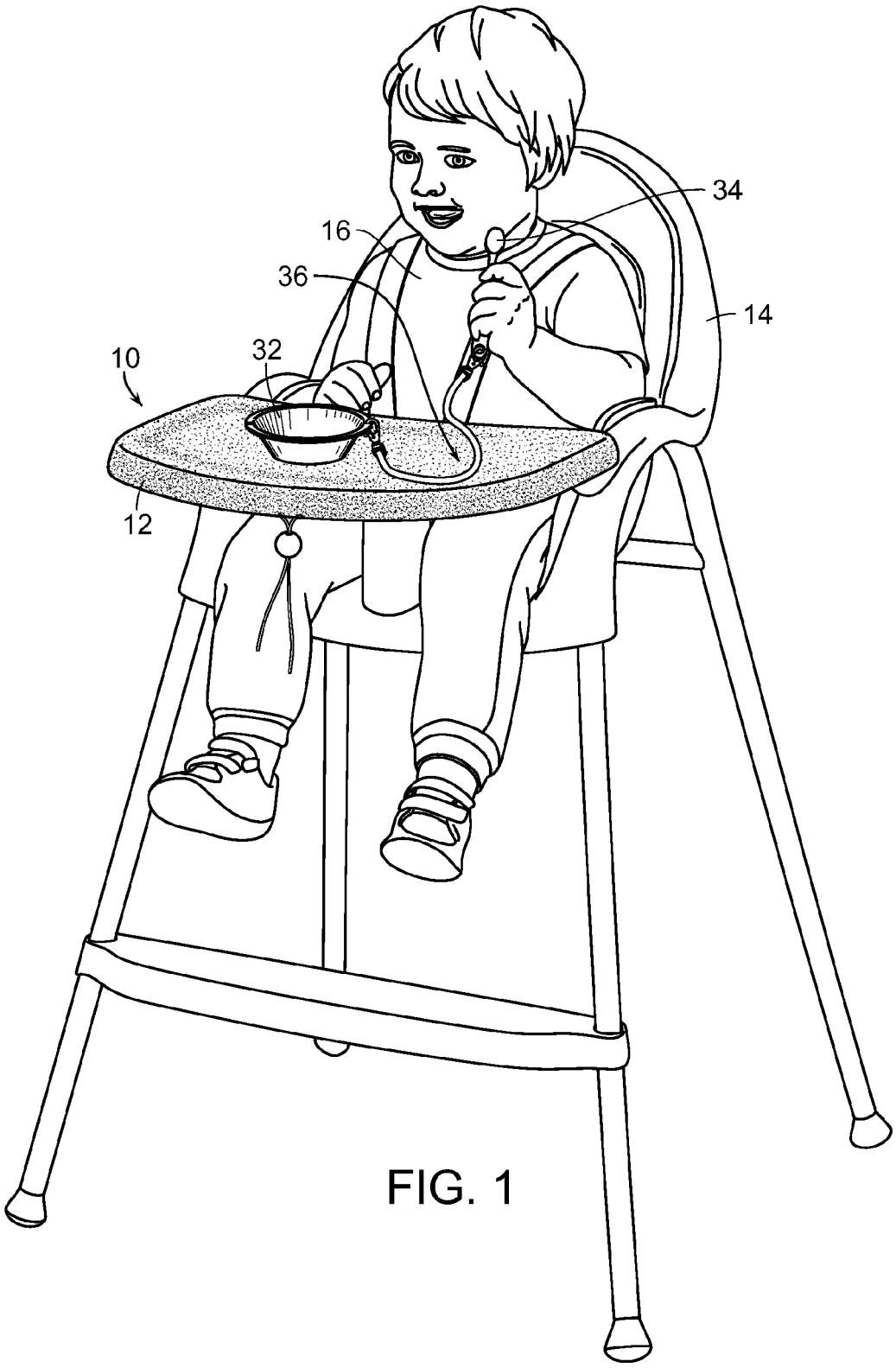
FIG. 1 is a perspective view of a child in a highchair implementing the system of the present invention.

As illustrated in FIG. 1, it is very common and well known to place infants and children 16 into a highchair 14, which has a tray 12 removably attached to the highchair 14. In this manner, the child 16 is held securely in place while the child is fed or feeds himself or herself, or plays with toys and other objects on the tray 12. However, it is a common occurrence that the infant or young child 16 will turn over dishes of food or even throw the dish, toy or other object from the tray 12. It is also common, particularly when the infant or young child 16 is feeding himself or herself, that the tray become quite messy from the food and liquid spills as the child is not yet adept at feeding himself or herself, and in other cases the child or infant 16 finds enjoyment in playing with the food.

Figure 2:
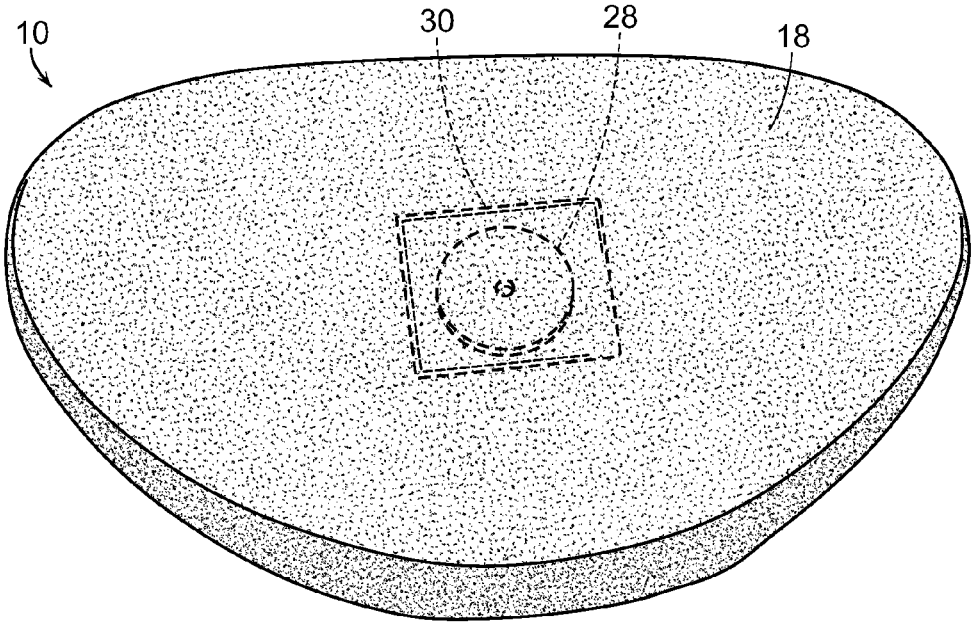
FIG. 2 is a top perspective view of a highchair tray incorporating the system of the present invention.
Figure 3:
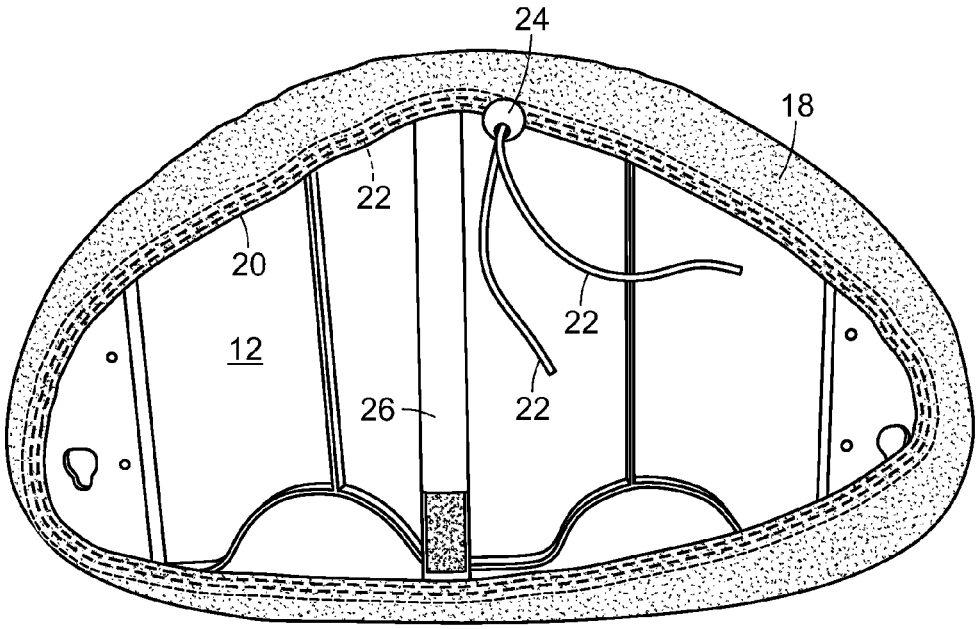
FIG. 3 is a bottom view of the highchair tray, illustrating the attachment of a slipcover used in accordance with the present invention.
Figure 4:
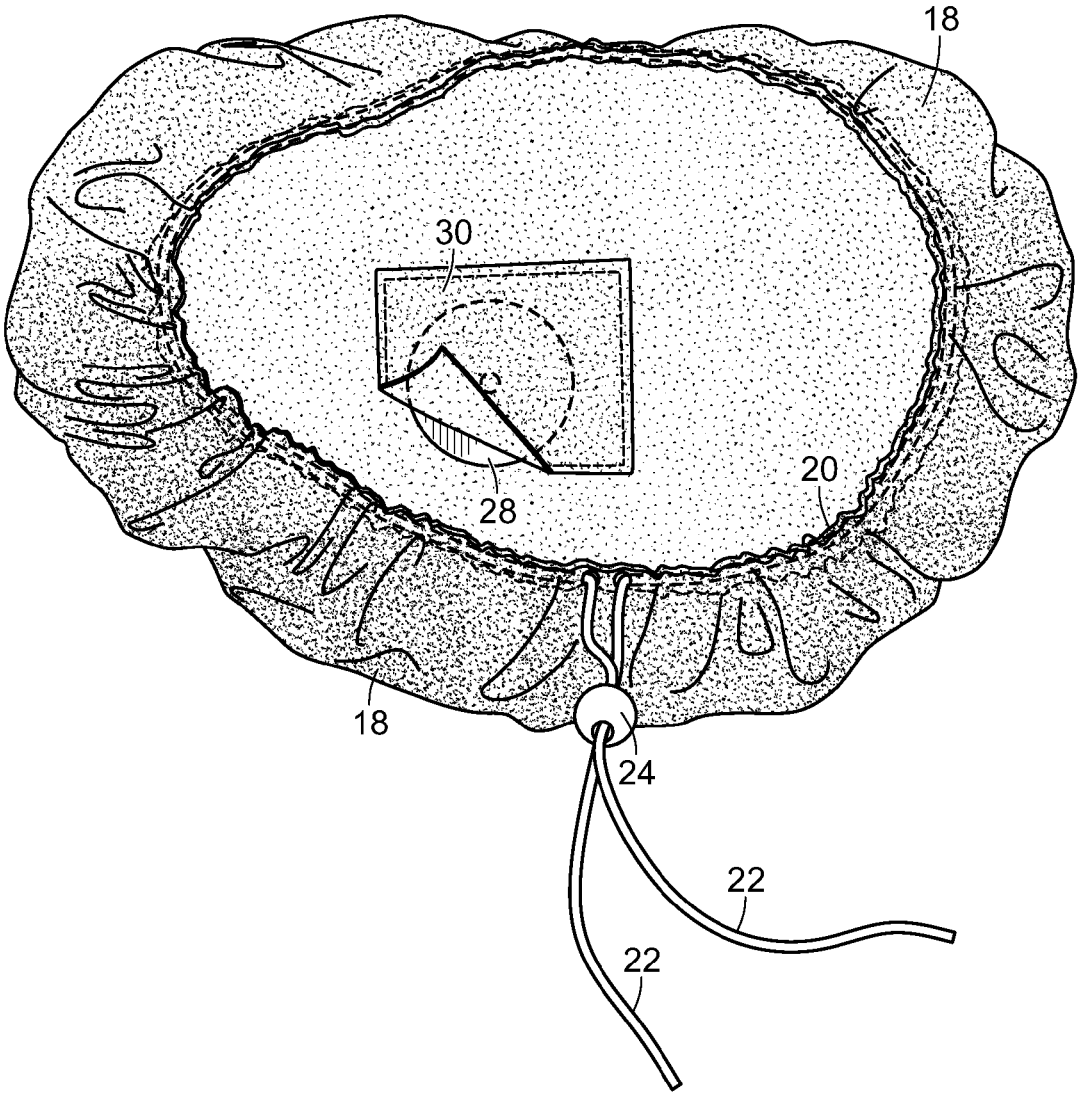
FIG. 4 is a bottom view of an exemplary slipcover having a pouch for holding a permanent magnet therein, in accordance with the present invention.

With reference now to FIGS. 2-4, the highchair system 10 of the present invention includes a slipcover 18 which is removably attachable to the highchair tray 12. The slipcover 18 is comprised of a washable material, such as a fabric or plastic material. A fabric having a plastic overlay, laminate quality or an otherwise liquid impermeable layer may be used for the slipcover 18 such that the slipcover is fluid resistant or fluid impermeable. The slipcover 18 may be comprised of eco-friendly materials, and materials that are approved by the Consumer Product Safety Improvement Act (CPSIA), and which are Bisphenol A (BPA) free.

The slipcover 18 is comprised of a flexible material, such as a thin plastic material and/or a fabric material or the like, so as to be easily removably attachable to the highchair tray 12. Typically, the slipcover 18 has a dimension which is larger than that of the upper surface of the underlying tray 12. Typically, the slipcover 18 extends over the upper surface of the highchair tray 12 as well as over the side walls of the highchair tray 12 such that a free peripheral edge 20 is disposed below the highchair tray 12, as illustrated in FIGS. 2 and 3.

It is anticipated that the slipcover 18 of the present invention will be capable of being used with existing highchair trays 12, without the need to create a specialized highchair tray or alter the highchair tray. Although there are size and configuration differences within highchair trays, it is anticipated that only a few, and possibly as few as a single, slipcover 18 will be able to accommodate the majority of the different sizes of configurations of existing highchair trays 12.

In order to accommodate highchair trays of different sizes and configurations, the slipcover 18 typically includes an adaptive connector that facilitates connection of the slipcover 18 to the highchair tray 12. The adaptive connector allows the slipcover to be adjusted in size or configuration so as to fit securely on the highchair tray 12. One such adaptive connector could comprise an elastic cord or band 22 disposed adjacent to at least a portion of the peripheral edge 20 of the slipcover 18. For example, a sleeve could be formed at the peripheral edge into which the elastic cord or band is disposed. Such an elastic sleeve or band will cause the peripheral edge 20 to constrict and bunch together, as illustrated in FIG. 4, yet enable the user to stretch the peripheral edge 20 by stretching the elastic cord or band to fit over the highchair tray 12.

With continuing reference to FIGS. 3 and 4, free ends of the elastic cord 22 can extend from the slipcover and be drawn to tighten the slipcover 18 on the highchair tray 12, as illustrated in FIG. 3. A lock 24 could be associated with the cord 22 for selectively locking the cord 22. For example, the lock 24 could comprise a ball stop, through which the ends of the elastic cord 22 can be pulled and held in place in order to tighten the slipcover 18 onto the tray 12. The ball stop lock 24 has a mechanism, such as a spring-biased member, which can be actuated so as to release or allow the cord 22 to be pulled therefrom and loosen or tighten the slipcover 18 with respect to the tray 12. In this manner, the tension of the elastic cord 22 can be adjusted so as to tighten the slipcover 18 onto the highchair tray 12, or so as to be loosened and remove the slipcover 18 from the highchair tray 12.

It will be understood by those skilled in the art that the cord 22 need not be elastic in nature, but instead can be comprised of a fiber, plastic, etc. which does not have elastic characteristics but due to the use of the locking mechanism 24 can be selectively drawn to tighten the slipcover 18 onto the highchair tray 12, and loosened so as to remove the slipcover 18 from the highchair tray 12. Such a non-elastic cord could be used in conjunction with an elastic band or cord 22 sewn into or otherwise associated with the slipcover 18 or these two types of connections could be used independently.

Hook and loop tape fasteners 26 could also comprise the adaptive connector, and be used to adjustably connect the slipcover 18 to the highchair tray 12. Corresponding pieces of hook or loop tape could be adhered or otherwise fastened to the slipcover 18 as well as the bottom surface of the highchair tray 12 and removably fastened to one another to hold the slipcover 18 onto the highchair tray 12. Alternatively, a band of hook and loop tape 26, as illustrated in FIG. 3, could extend from generally opposite sides of the slipcover 18 and be adjustably tightened and fastened so as to secure the slipcover 18 onto the highchair tray 12. More than one such hook and loop tape cross-strap 26 could be used for this purpose. Such hook and loop tape adaptive connector fasteners could be used instead of the elastic cord or cord and locking mechanisms. However, in other cases, the hook and loop tape fastener 26 could be used in addition to the elastic cord 22 and adjustable locking mechanism 24 to further control the fit of the slipcover 18 onto the highchair tray 12. It will also be understood that other adaptive connectors or attachment mechanisms may be utilized in addition to, or instead of, the above described and illustrated connecting and fastening mechanisms.

Use of the slipcover 18 enables spilt food and liquid to remain on and be collected by the slipcover 18. When the infant or child 16 is finished eating, the parent or caregiver can simply remove the slipcover 18 from the highchair tray 12, and invert and/or bunch together the slipcover 18 so as to capture the food and/or liquid contained in the upper surface thereof and take the slipcover 18 to a garbage or sink so as to dispose of the spilt food and/or liquid. Due to its construction, the slipcover 18 can be washed with warm soapy water and rinsed, in the event such additional cleaning is necessary. The slipcover 18 is preferably comprised of a material which enables the slipcover 18 to be reused repeatedly.

In a particularly preferred embodiment of the invention, objects, such as dishes and/or toys, are removably attached to the slipcover 18 and highchair tray 12 by magnetic attraction. As such, a material having magnetic attraction properties is associated with the slipcover. Objects comprising ferromagnetic material or a magnet can be placed over the material associated with the slipcover and held in place on the highchair tray 12 by magnetic attraction forces. As such, a combination of ferromagnetic materials and magnets may be associated with the slipcover 18 and the object to be removably attached to the slipcover 18 and highchair tray 12. It is possible that a permanent magnet be associated with the slipcover 18 and that another permanent magnet be attached to a lower surface or otherwise associated with the object to be attached to the highchair tray 12, so long as the magnetic forces are such that they attract one another instead of repelling one another. Thus, the orientation of the permanent magnets would need to be such so as to attract as opposed to repel. Alternatively, a permanent magnet is associated with either the slipcover 18 or the object to be removably attached to the highchair tray 12 and a material having magnetic attraction characteristics, such as a ferromagnetic material including many types of metals, be associated with the slipcover 18 or object, such that the permanent magnet will attract the ferromagnetic material and cause the object to be removably attached to the highchair tray 12.

With reference to FIGS. 2 and 4, in the illustrated embodiment a permanent magnet 28 is inserted within a pouch 30 sewn onto the lower surface of the slipcover 18 so as to hold the magnet 28 therein. The pouch may be selectively opened and closed, such as by hook and loop tape fastener, snaps, etc. such that the magnet 28 can be removable should the user want to clean the slipcover 18. Typically, when utilizing a single magnet 28, the magnet 28 and pouch 30 are generally centered in the slipcover 18.

This allows the object to be placed generally in the central area of the highchair tray 12 so as to provide easy access to the child. However, it will be appreciated that the invention contemplates either multiple magnets associated with the slipcover 18, such as utilizing multiple pouches 30, or even a relatively large magnet which would extend across a substantial area of the slipcover 18. It will also be understood that the one or more magnets 28 can be permanently associated with the slipcover 18. The magnet is of a sufficient strength so as to securely hold an object comprised of ferromagnetic material or including a magnet, tightly to the highchair tray 12 so as to prevent the child or infant from removing the object, but enabling the parent or caregiver to remove the object from the highchair tray 12.

Figure 5:
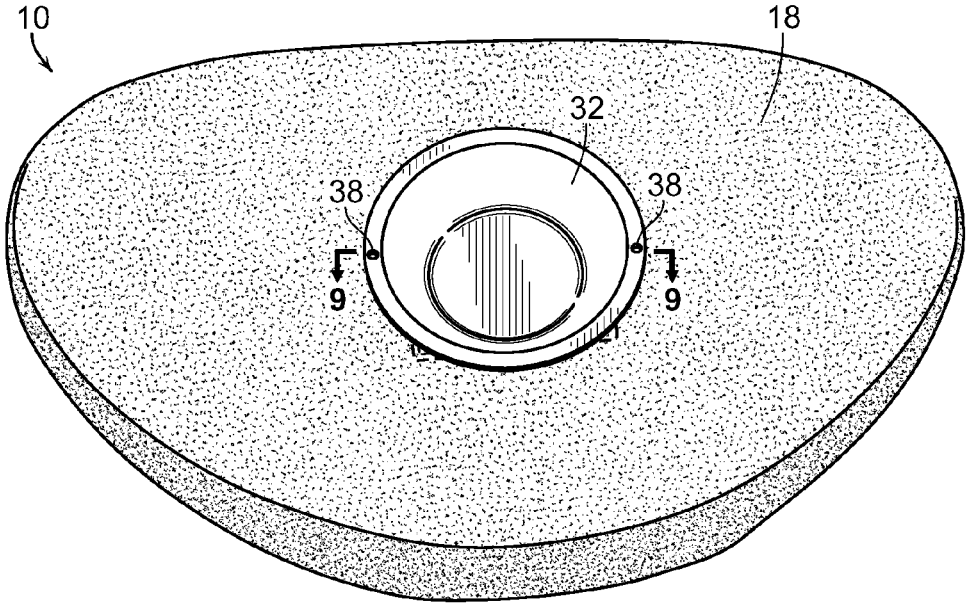
FIG. 5 is a top view similar to FIG. 2, but illustrating a dish magnetically attached to the slipcover and tray, in accordance with the present invention.
Figure 6:
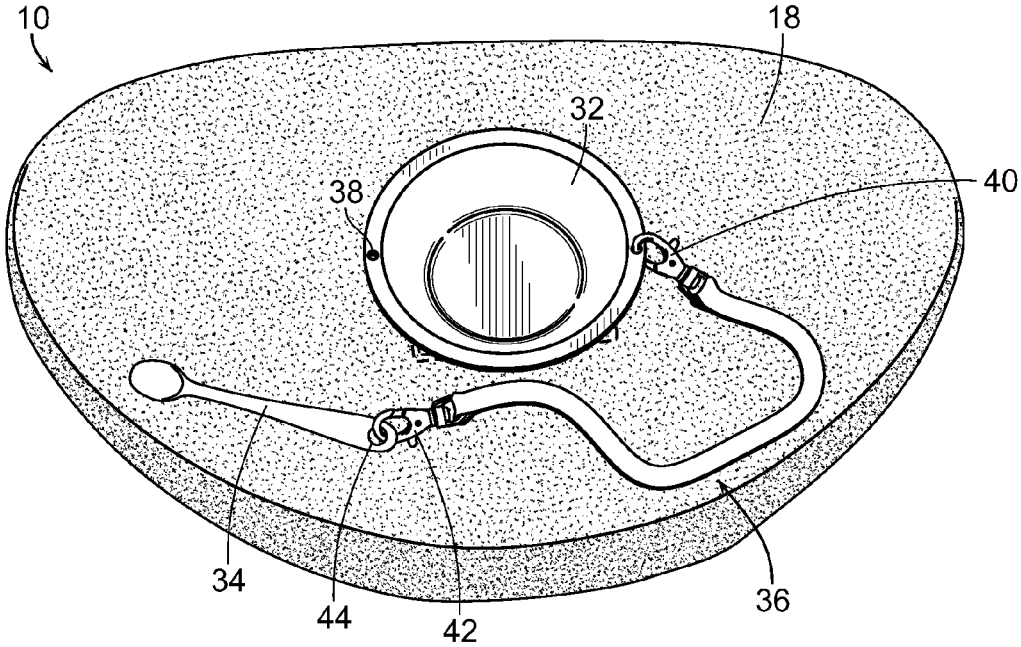
FIG. 6 is a top perspective view, similar to FIG. 6, but illustrating a utensil tethered to the dish, in accordance with the present invention.

With reference now to FIGS. 5 and 6, a dish 32, in the form of a bowl, is illustrated attached to the slipcover 18 which is disposed over and connected to a highchair tray 12. The dish 32, as described above, either has a corresponding magnet attached to the base thereof, or includes magnets embedded therein or otherwise has magnetic properties, or is comprised of a ferromagnetic material, such as metal. Although it is possible that the dish 32 have a magnet attached thereto or incorporated therein, this would require specialized dishes, and thus the invention in its preferred form has a magnet associated with the slipcover 18 and requires only objects, such as the illustrated dish, be comprised of a material which is attracted to magnets, such as many different types of metals, including stainless steel. It will be appreciated that the dish 32 is not limited to the illustrated bowl, but instead can be a plate or even a cup.

Figure 9:
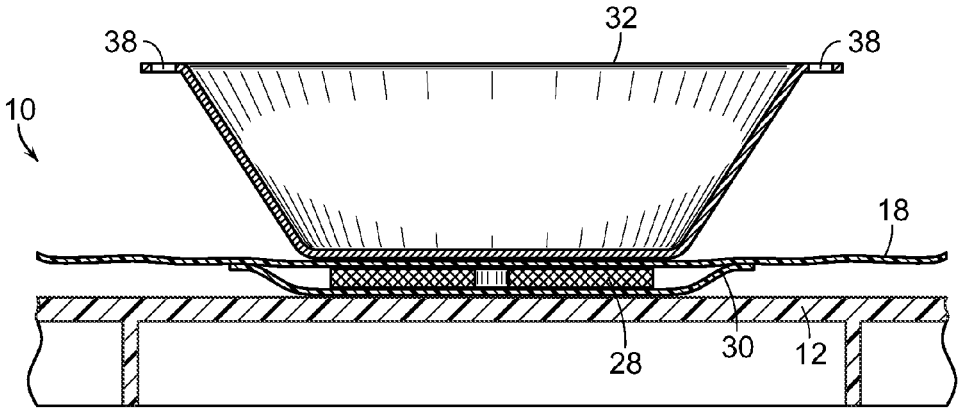
FIG. 9 is a cross-sectional view taken generally along line 9-9 of FIG. 5, illustrating a magnetic connection between a dish and magnet housed in a slipcover and disposed over a highchair tray, in accordance with the present invention.

With reference now to FIG. 9, it can be seen that when the dish 32 is placed on top of the slipcover 18 and the highchair tray 12, so as to be over the permanent magnet 28, the dish 32, comprised of a magnetically attracting material, such as a ferromagnetic material, becomes releasably attached to the slipcover 18, and thus to the highchair tray 12. Preferably, as described above, the magnet 28 is of a sufficient strength such that the child 16 cannot lift or otherwise remove and throw the dish 32 and its contents. However, the much stronger parent or caregiver can lift and remove the dish 32 from the slipcover 18.

In some instances, the infant or child will eat food, such as cereal or crackers, with his or her fingers and hands. In other instances, the infant or child will use a utensil, such as the illustrated spoon 34. Of course, the utensil 34 could be of another variety, such as a fork, spork, etc. In order to prevent the child from throwing the utensil, the utensil 34 is attached to the dish 32 with a tether 36. In one embodiment, the utensil 34 is removably attached to the tether 36, and/or the utensil 34, tether 36 and dish 32 are removably attachable to one another. Of course, the utensil 34, tether 36 and dish 32 could be permanently attached to one another, although it is preferred that they be removably attached to one another as this would enable different utensils 34 to be used in conjunction with different dishes 32.

With continuing reference now to FIGS. 5-8, in the illustrated embodiment apertures 38 are formed in the dish, such as at a peripheral edge thereof, to enable a clasp 40 at one end of the tether 36 to be attached thereto. A clasp 42 at an opposite end of the tether 36 is connected to the utensil, such as by being inserted into an aperture 44 at an end thereof. It will be understood, however, that different arrangements can be used in order to removably attach the utensil 34 to the dish 32, such as by means of a tether 36 which has a magnet associated therewith so as to be magnetically coupled to the dish 32. Other attachment means and mechanisms are also contemplated by the present invention. The important aspect is that the utensil 34 is tethered to the dish 32 to prevent the child from throwing the spoon, fork or other utensil 34 from the highchair 14.

Figure 7:
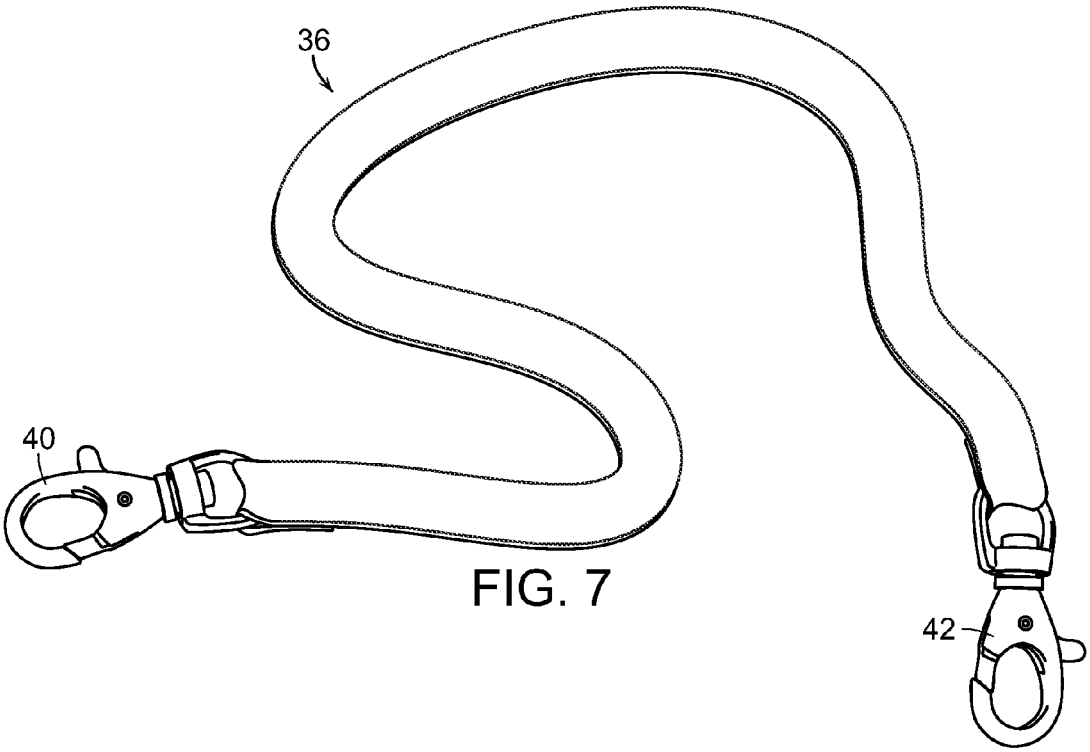
FIG. 7 is a perspective view of an exemplary tether used in accordance with the present invention.
Figure 8:
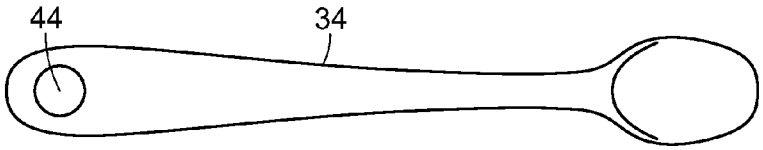
FIG. 8 is a top view of a spoon utensil which can be used in accordance with the present invention.

With reference now to FIG. 7, in the illustrated embodiment, the tether 36 may be comprised of various materials. For example, the tether 36 may be comprised of a fabric material, for design and safety purposes. The tether 36 should be of a sufficient length so that the child can bring the utensil 34 from the dish 32 to his or her mouth. However, the tether 36 should not be of such a length that the child can wrap the tether 36 around his or her neck, and present a choking or safety hazard. It will be understood that the utensil 34, dish 32 and/or tether 36 be comprised of materials which are deemed safe for children, such as being CPSIA approved, BPA free, and eco-friendly.

Figure 10:
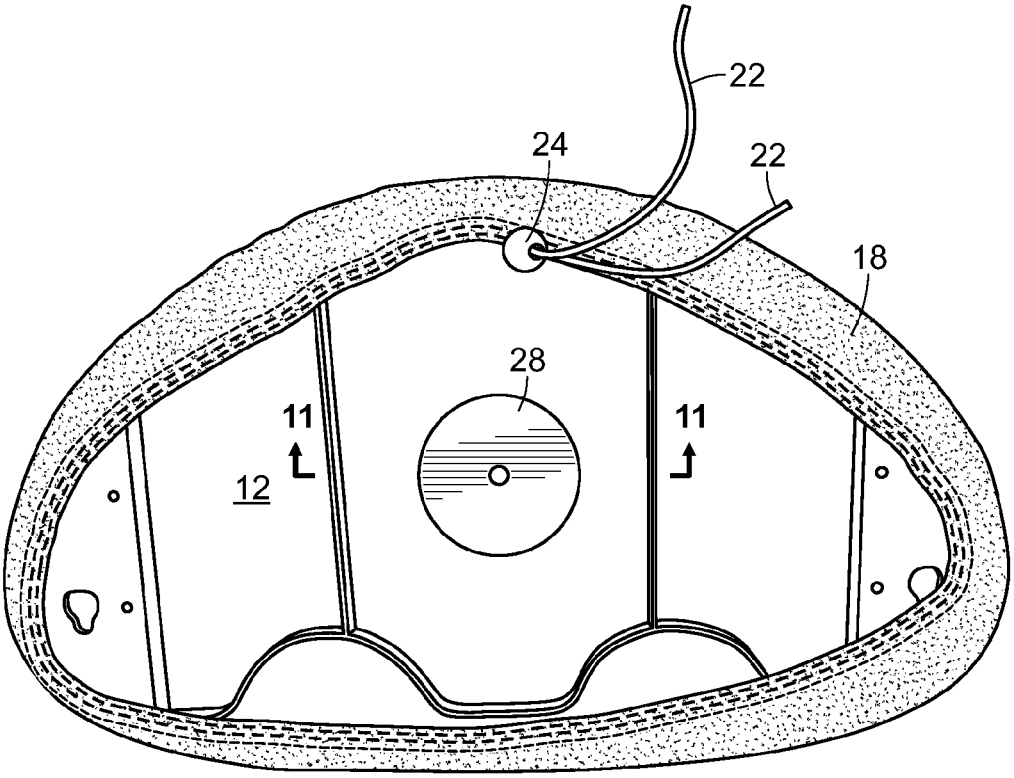
FIG. 10 is a bottom view of a slipcover attached to a highchair tray, and a magnet attached to a bottom surface of the highchair tray, in accordance with the present invention.
Figure 11:
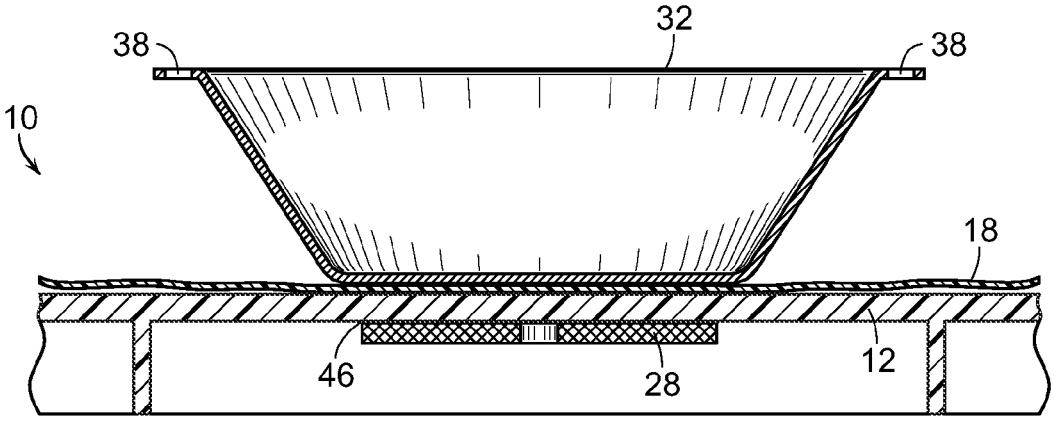
FIG. 11 is a cross-sectional view taken generally along line 11-11 of FIG. 10, illustrating the magnetic connection of a dish to the slipcover and tray, in accordance with the present invention.

With reference now to FIGS. 10 and 11, instead of housing the one or more magnets 28 within pouches of the slipcover 18, or otherwise attaching the magnets 28 to the slipcover 18, the one or more magnets 28 may be attached to a bottom surface of the highchair tray 12, as illustrated. This could be done, for example, by having a peel-away layer covering adhesive on a surface of the magnet. The adhesive 46 would be attached to the bottom surface of the tray 12, affixing the magnet 28 thereto.

The slipcover 18 would be attached to the highchair tray 12 and the dish 32 or other object would be placed on the slipcover 18 and tray 12 over the magnet 28. With a sufficient magnetic strength, the magnet 28 would hold the dish 32 firmly and securely onto the slipcover 18 and highchair tray 12, such that the infant or child would not be easily able to remove the dish 32 or object.

It will be understood that although a single magnet 28 is illustrated attached to the bottom surface of the highchair tray 12, a much larger magnet could be attached to the bottom surface of the tray, or multiple magnets could be attached to the bottom surface of the tray 12 so as to permit multiple dishes or other objects to be removably attached to the tray 12. One benefit of this arrangement is that the one or more magnets 28 need not be removed from the slipcover 18 when washing the slipcover.

It is contemplated by the present invention that in addition to dishes 32 be magnetically secured to the slipcover 18 and highchair tray 12, toys that have a base of magnetically attractable material or a magnet attached to or otherwise embedded therein could be removably attached to the slipcover 18 and/or highchair tray 12, such that the child could have a toy to play with while at the highchair, while being unable to throw or drop the toy from the highchair tray.

In use, the slipcover 18 is attached to the highchair tray 12, such as by stretching the slipcover 18 over the top surface of the highchair tray 12, such that the edges wrap around to at least the side walls of the highchair tray 12, and preferably to the underside of the highchair tray 12, as illustrated in FIGS. 2 and 3. Adjustments to the adaptive connector are made as necessary, such as by adjusting the length of the cord 22 and using the locking mechanism 24 so as to adjust the fit and tension of the slipcover 18 onto the tray 12. A hook and loop cross-strap 26 may also be adjusted and fastened in order to ensure a tight fit. The child 16 is placed within the highchair 14, and the highchair tray 12, having the slipcover 18 thereon, is attached to the highchair 14. The desired object is then placed onto the highchair tray 12, so as to be magnetically attracted to the slipcover and tray, such as the illustrated and described permanent magnet 28. The object may be a dish comprised of a magnetically attractable metal, such as a ferromagnetic material, so as to be magnetically attracted to and removably connected to a position over the permanent magnet(s) 28.

A tether 36 is attached to the dish 32. If necessary, a utensil 34 is attached to the opposite end of the tether, such as by utilizing the illustrated clasps 40 and 42. The child can now eat his or her meal and will be unable to throw their dish or their utensil. By taking away the child's ability to throw their dish and utensil, it is anticipated that the child will learn to eat with utensils much faster. It is also believed that the parent or caregiver will experience less frustration and cleanup at meal time.

After the meal, the parent or caregiver may first remove the dish and attached utensil 34. For minor messes, the slipcover 18 may be cleaned using a cloth or paper towel. In other instances, the slipcover 18 is removed in such a manner so as to essentially somewhat invert the slipcover 18 and retain the food, liquid, etc. within the slipcover 18, until it is disposed of in a trashcan or a sink. Thereafter, the slipcover 18 can be cleaned with soap, water, etc. as necessary.

It is contemplated that lids be provided for the dish, such that if the child did not consume all the food within the dish 32, the dish can be tightly sealed and the food presented to the child in the future.

It will be appreciated that the present invention enables parents and caregivers to utilize their existing highchair and tray, or any commercially available highchair or tray desired to be purchased, without the need of specialized trays or dishes. The slipcover 18 of the present invention can be used with a variety of highchair trays having various sizes and configurations. Moreover, the use of permanent magnets associated with the slipcover 18 enables the use of off-the-shelf dishes comprised of a ferromagnetic material.

Although several embodiments have been described in detail for purposes of illustration, various modifications may be made without departing from the scope and spirit of the invention. Accordingly, the invention is not to be limited, except as by the appended claims.

What is claimed is:

1. A highchair system that enables removable attachment of objects to a tray of a highchair and protects the highchair tray from food and liquid spills, the system comprising:

a flexible slipcover removably attachable to the highchair tray so as to extend over and cover an upper surface and at least a portion of a side wall of the highchair tray, the slipcover being comprised of a material or having an upper surface that is fluid resistant or fluid impermeable, the slipcover including an adaptive connector that facilitates connection of the slipcover to the highchair tray; and a magnet disposed below the upper surface of the slipcover and relative the highchair tray such that objects comprising ferromagnetic material or a magnet placed on the slipcover over the magnet are held in place on the highchair tray by magnetic attraction forces.

2. The highchair system of claim 1, wherein the adaptive connector comprises an elastic disposed adjacent to at least a portion of a peripheral edge of the slipcover.

3. The highchair system of claim 1, wherein the adaptive connector comprises a cord associated with the slipcover and selectively drawn to tighten the slipcover on the highchair tray and a lock associated with the cord for selectively locking the cord.

4. The highchair system of claim 1, wherein the adaptive connector comprises hook and loop tape fasteners.

5. The highchair system of claim 1, wherein the magnet is attached to a lower surface of the highchair tray.

6. The highchair system of claim 1, wherein the magnet is disposed within a pouch formed in the slipcover.

7. The highchair system of claim 1, including a dish comprised of a ferromagnetic material or including a magnet removably attached to the slipcover by magnetic attraction to the magnet.

8. The highchair system of claim 7, including a tether interconnecting a utensil to the dish.

9. A highchair system that enables removable attachment of objects to a tray of a highchair and protects the highchair tray from food and liquid spills, the system comprising:

a flexible slipcover removably attachable to the highchair tray so as to extend over and cover an upper surface and at least a portion of a side wall of the highchair tray, the slipcover being comprised of a material or having an upper surface that is fluid resistant or fluid impermeable, the slipcover including an adaptive connector that facilitates connection of the slipcover to the highchair tray;

a magnet removably inserted into a pouch of the slipcover;

a dish comprised of a ferromagnetic material or including a magnet removably attached to the slipcover by magnetic attraction to the magnet; and a tether interconnecting a utensil to the dish.

10. The highchair system of claim 9, wherein the adaptive connector comprises an elastic disposed adjacent to at least a portion of a peripheral edge of the slipcover.

11. The highchair system of claim 9, wherein the adaptive connector comprises a cord associated with the slipcover and selectively drawn to tighten the slipcover on the highchair tray and a lock associated with the cord for selectively locking the cord.

12. The highchair system of claim 9, wherein the adaptive connector comprises hook and loop tape fasteners.

13. A highchair system that enables removable attachment of objects to a tray of a highchair and protects the highchair tray from food and liquid spills, the system comprising:

a flexible slipcover removably attachable to the highchair tray so as to extend over and cover an upper surface and at least a portion of a side wall of the highchair tray, the slipcover being comprised of a material or having an upper surface that is fluid resistant or fluid impermeable, the slipcover including an adaptive connector that facilitates connection of the slipcover to the highchair tray;

a magnet disposed on the highchair tray below the slipcover;

a dish comprised of a ferromagnetic material or including a magnet removably attached to the slipcover by magnetic attraction to the magnet; and a tether interconnecting a utensil to the dish.

14. The highchair system of claim 13, wherein the adaptive connector comprises an elastic disposed adjacent to at least a portion of a peripheral edge of the slipcover.

15. The highchair system of claim 13, wherein the adaptive connector comprises a cord associated with the slipcover and selectively drawn to tighten the slipcover on the highchair tray and a lock associated with the cord for selectively locking the cord.

16. The highchair system of claim 13, wherein the adaptive connector comprises hook and loop tape fasteners.

* * * * *